United States Patent [19]

Watkins

[11] Patent Number: 4,908,888

[45] Date of Patent: Mar. 20, 1990

[54] DRY HYDRO-MASSAGE UNIT

[75] Inventor: Jonathan Watkins, Vista, Calif.

[73] Assignee: Watkins Manufacturing Corporation, Carlsbad, Calif.

[21] Appl. No.: 316,047

[22] Filed: Feb. 24, 1989

[51] Int. Cl.[4] ..... A61H 9/00; E04H 3/18

[52] U.S. Cl. ..... 4/542; 128/64

[58] Field of Search ..... 4/541, 542; 178/64

[56] References Cited

U.S. PATENT DOCUMENTS

| | | | |
|---|---|---|---|
| 992,905 | 5/1911 | Robinson . | |
| 1,076,490 | 10/1913 | Dreuw | 178/64 |
| 2,591,252 | 4/1952 | Gilson . | |
| 3,273,560 | 9/1966 | Jacuzzi . | |
| 3,297,025 | 1/1966 | Jacuzzi . | |
| 3,302,640 | 2/1967 | Jacuzzi . | |
| 3,396,722 | 8/1968 | Lindberg, Jr. . | |
| 3,452,370 | 7/1969 | Jacuzzi . | |
| 3,483,862 | 12/1969 | Takeuchi | 121/64 |
| 3,540,438 | 11/1970 | Jacuzzi . | |
| 3,571,820 | 3/1971 | Jacuzzi . | |
| 3,674,020 | 7/1972 | Jacuzzi . | |
| 3,720,204 | 3/1973 | Wojtowicz . | |
| 3,736,924 | 6/1973 | Jacuzzi et al. . | |
| 3,768,462 | 10/1973 | Boulard . | |
| 3,784,374 | 4/1975 | Jacuzzi . | |
| 3,806,964 | 4/1974 | Vanegas et al. . | |
| 3,820,173 | 6/1974 | Weller . | |
| 3,842,823 | 10/1974 | Jucuzzi et al. . | |
| 3,905,358 | 9/1975 | Jacuzzi . | |
| 4,139,001 | 2/1979 | Macabee . | |
| 4,200,145 | 9/1980 | Stamp et al. . | |
| 4,335,854 | 6/1982 | Revnoso . | |
| 4,339,833 | 7/1982 | Mandell . | |
| 4,523,340 | 6/1985 | Watkins . | |
| 4,561,133 | 12/1985 | Laing . | |
| 4,575,882 | 3/1986 | Diamond . | |
| 4,665,572 | 5/1987 | Davidson et al. . | |
| 4,679,258 | 7/1987 | Henkin et al. . | |
| 4,692,950 | 9/1987 | Henkin et al. . | |
| 4,731,887 | 3/1988 | Henkin et al. . | |

*Primary Examiner*—Charles E. Phillips

*Attorney, Agent, or Firm*—Edgar A. Zarins; Malcolm L. Sutherland

[57] ABSTRACT

A unit for use in a tub or spa to provide a dry hydro-massage of the neck and shoulders. The unit mounts to the tub edge and includes a diaphragm which sealingly covers a discharge jet such that the fluid will flex the diaphragm into massaging relationship with the user's body. The water is exhausted, into the tub through a secondary port below the water line such that dry hydro-therapy is provided by the unit. The unit is mounted to the side wall of the tub spa. The inflation of the diaphragm is controlled by pressure regulating ports formed within the housing to control the exhaust of fluid from the jet chamber. In one embodiment, the ports are variable to vary the inflation pressure of the diaphragm. With the unit mounted to the tub the user may remain seated within the spa while the unit provides a dry hydro-massage of the neck and upper back normally positioned above the water line. The diaphragm unit is adapted to be utilized with various jet nozzles.

17 Claims, 2 Drawing Sheets

DRY HYDRO-MASSAGE UNIT

BACKGROUND OF THE INVENTION

I. Field of the Invention

This invention relates to a hydro-massage unit for a tub, whirlpool spa or the like and, in particular, to a dry hydro-massage unit which includes means for regulating the inflation pressure of the resilient diaphragm to provide a dry, warm impact massage of upper body portions while the user is situated within the tub.

II. Description of the Prior Art

Hydrotherapy jet discharges for whirlpool tubs and spas have been developed to provide a turbulent mix of water and air for impacting against a user's body in the spa. These discharges have been refined to provide efficient flow with maximum therapeutic benefit. Discharge jets which are selectively directionally adjustable by the user and jets which travel along a closed path are well known embodiments for increasing the benefits of the spa. However, these discharge jets must be positioned below the water line within the spa to minimize splash. As a result, the therapeutic benefits are limited to the body parts below the water line or the user must slouch down in an attempt to apply the massaging effect to the shoulders.

Closed dry hydro-massage systems have been developed for specific devices such as water beds. These systems circulate the water from a closed reservoir against a membrane which engages the user. The membrane may form the back of a car seat or the upper surface of a waterbed mattress. However, such systems have not been employed in spas to provide hydromassage of selected body parts. Moreover, the massage is dependent solely on the impact action of the water jet against the flexible membrane since no means are provided for maintaining inflation of the membrane.

SUMMARY OF THE PRESENT INVENTION

The present invention overcomes the disadvantages of the prior known hydro-massage systems by providing a dry hydro-massage unit for a spa which includes pressure regulating means to maintain inflation of a flexible diaphragm to provide a comfortable resilient surface for the user while massaging the user's neck and shoulders normally disposed above the water line.

The dry hydro-massage unit according to the present invention generally comprises a housing mounted to a tub or spa wall having air and water supply means to supply a turbulent mixture to the discharge head. The discharge head is sealingly positioned behind a flexible diaphragm such that the discharge is directed against the diaphragm. The housing is provided with an air vent at the top to allow air to escape and a water exhaust at the bottom of the housing. The water exhaust fluidly communicates with the tub to permit escape of the water back into the spa. The jet discharges into a regulated chamber formed partially by the flexible diaphragm and by an interior wall having a plurality of ports. The size and number of ports are selected to regulate the pressure within the chamber to ensure inflation of the diaphragm according to the discharge capacity of the discharge jet. In an alternative embodiment, a rotatable plate may be mounted to the interior wall to vary the size of the ports and, as a result, the inflation pressure of the diaphragm. The discharge head forces the air/water mixture against the diaphragm and the water is exhausted into the spa through a port below the water line. In this manner, a dry hydro-massage is provided to parts of the user's body disposed above the water line.

The present invention has the advantage of providing the therapeutic benefits of a hydro-massage to the neck and head area without the water splash of past known spa jets. As a result, water splash against the face and eyes is eliminated permitting the user to quietly enjoy the dry hyrdo-massage. The invention has the added benefit of keeping the user's hair and face dry thus allowing users with styled hairdos and makeup to enjoy the massaging benefits of the spa without ruining the hairdo or makeup. Additionally, the user is provided with a warm and resilient surface against which to lean as a result of inflation of the diaphragm. Without regulation of the fluid exhaust from the discharge chamber inflation of the diaphragm could not be maintained. Furthermore, the inflated massage pillow provides greater heat transfer over a wider area while the impact massage is specifically directed. The impact power of the jet can be varied by pump pressure, restricting the mixture of air and the exhaust of fluid.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
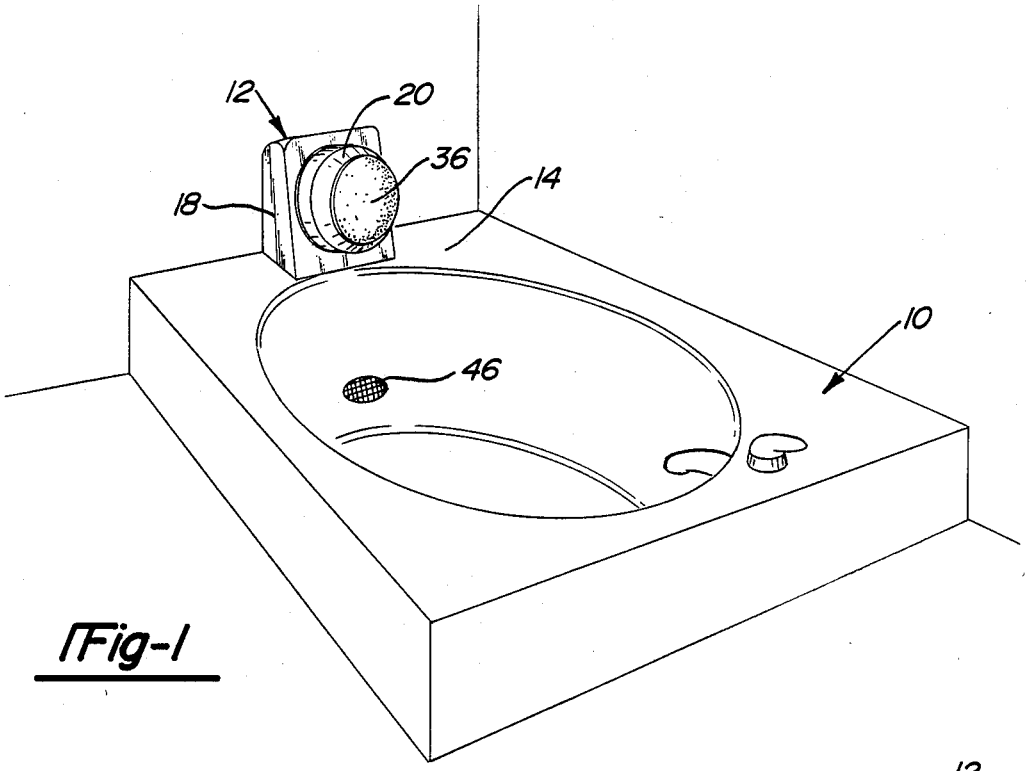
FIG. 1 is an elevated perspective of a tub having the dry hydro-massage unit embodying the present invention mounted thereto.
Figure 2:
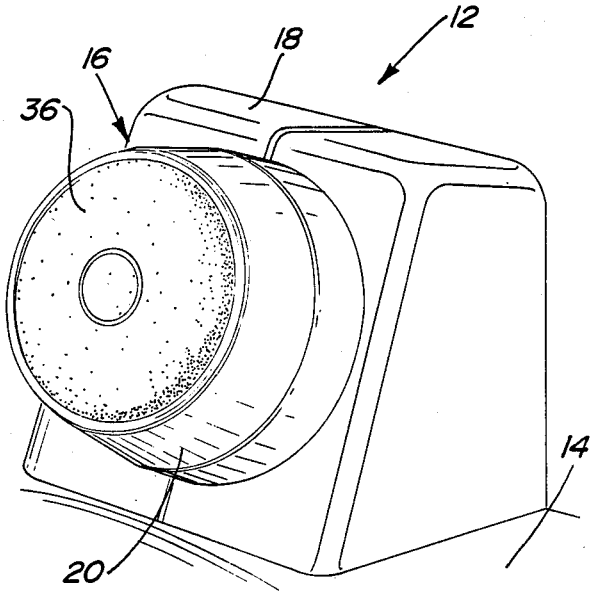
FIG. 2 is an elevated perspective of the dry hydro-massage unit of the present invention.

Referring first to FIGS. 1 and 2, there is shown a tub 10 to which a dry hydro-massage unit 12 embodying the present invention is mounted. The dry hydro-massage unit 12 may be mounted to any type receptacle adapted to receive a user including a whirlpool spa or a bathtub. In a preferred embodiment, the unit 12 is mounted to a top rim 14 of the tub 10 such that a user positioned in the tub 10 can lean against the dry hydro-massage unit 12 for the selective massage of body parts normally situated above the water line. The dry hydro-massage unit 12 provides the massaging effect of hydro-massage devices while eliminating the splash and spray of known units.

Figure 3:
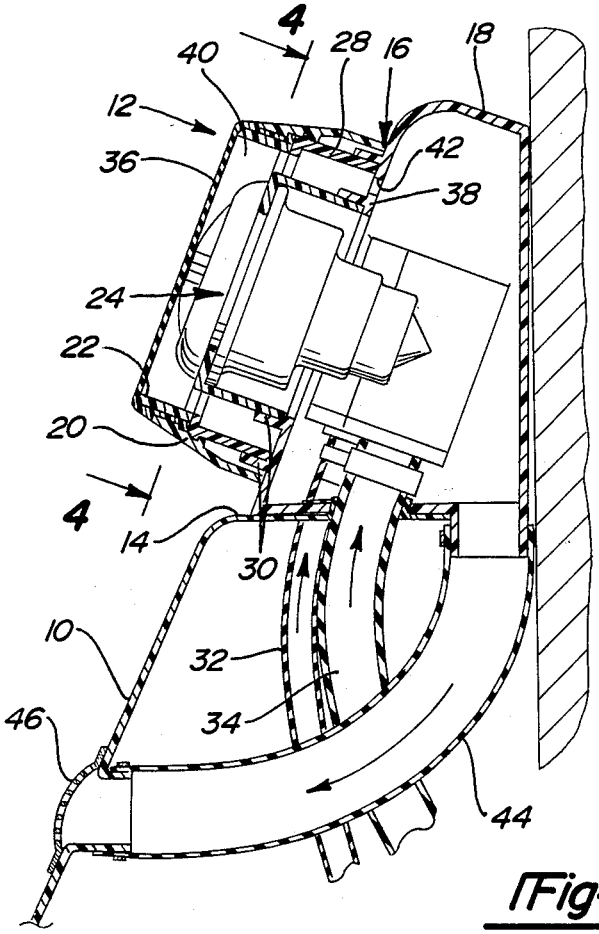
FIG. 3 is a cross-sectional view of the dry hydro-massage unit mounted to the tub.
Figure 4:
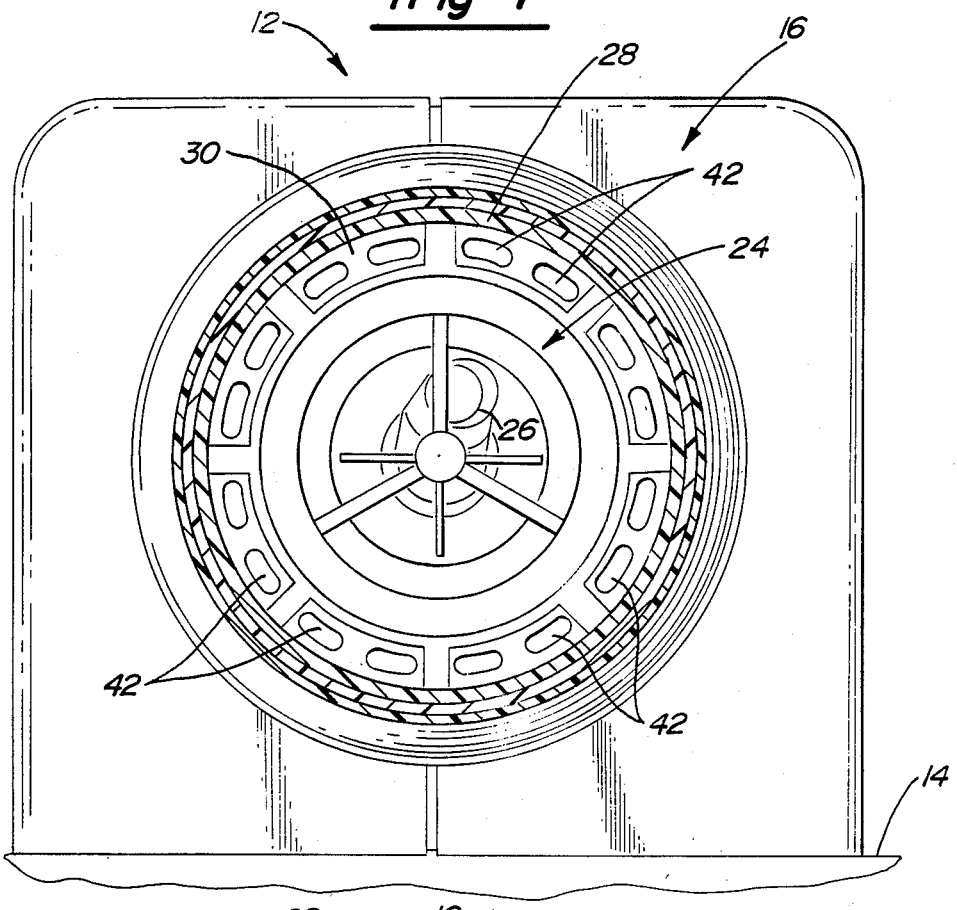
FIG. 4 is a front cross-sectional view of the dry hydro-massage unit taken along lines 4—4 of FIG. 3.

Referring now to FIGS. 2 through 4, the dry hydro-massage unit 12 of the present invention includes a housing 16 mounted to the tub rim 14. In a preferred embodiment, the housing 16 consists of a main body 18 to which is attached a bezel 20 forming a front opening 22 for the housing 16. Mounted within the housing 16 is a hydro-massage jet assembly 24 which includes a discharge jet 26. The jet assembly 24 is mounted within the housing 16 using a mounting bracket 28 which engages flanges 30 formed as part of the body 18 of the housing 16. Air and water are supplied to the jet assembly 24 through air line 32 and water line 34. The jet assembly 24 mixes the air and water using a venturi jet nozzle to produce the soothing massaging fluid discharged through the jet 26. The hydro-massage jet assembly 24 is positioned within the housing 16 such that the massaging fluid is directed through the front opening 22 of the housing 16.

To prevent the massaging fluid from being discharged against the user and therefore create the dry hydro-massage effect, a diaphragm 36 is sealingly mounted to the front opening 22 such that the massaging fluid is discharged against the diaphragm 36. Although discharging the massaging fluid to massagingly flex the diaphragm 36 will produce some soothing relief, the rigid structure of the housing 16 makes it uncomfortable for the user to relaxingly lean against the unit 12. Accordingly, in order to inflate the diaphragm 36 to form a pillow-like surface, a restrictive flow interior wall 38 is positioned within the housing 16. Together with the diaphragm 36, the interior wall 38 forms a pressure chamber 40 into which the massaging fluid is discharged. The wall 38 includes a plurality of circumferentially spaced ports 42 to restrict outlet flow from the chamber 40. The size and number of ports 42 are selected to create a predetermined fluid pressure within the chamber 40 such that the diaphragm 36 will be inflated to a desirable level according to the discharge flow of the hydro-massage jet assembly 24. Thus, as massaging fluid is discharged by jet assembly 24, the flow ports 42 of the interior wall 38 restrict the outlet flow of fluid from the chamber 40 creating a fluid pressure to inflate the diaphragm 36 to form a comfortable pillow. Fluid is exhausted from the housing 16 through an outlet line 44 which communicates with the tub basin through exhaust port 46. As a result, the massaging effects of the fluid can be felt by the user through the flexible diaphragm 36 while the spray of the water is eliminated. The discharged fluid is returned to the tub 10 below the water line. In addition, the body 18 of the housing 16 is provided with an air vent 48 to vent any air trapped within the housing 16.

Figure 5:
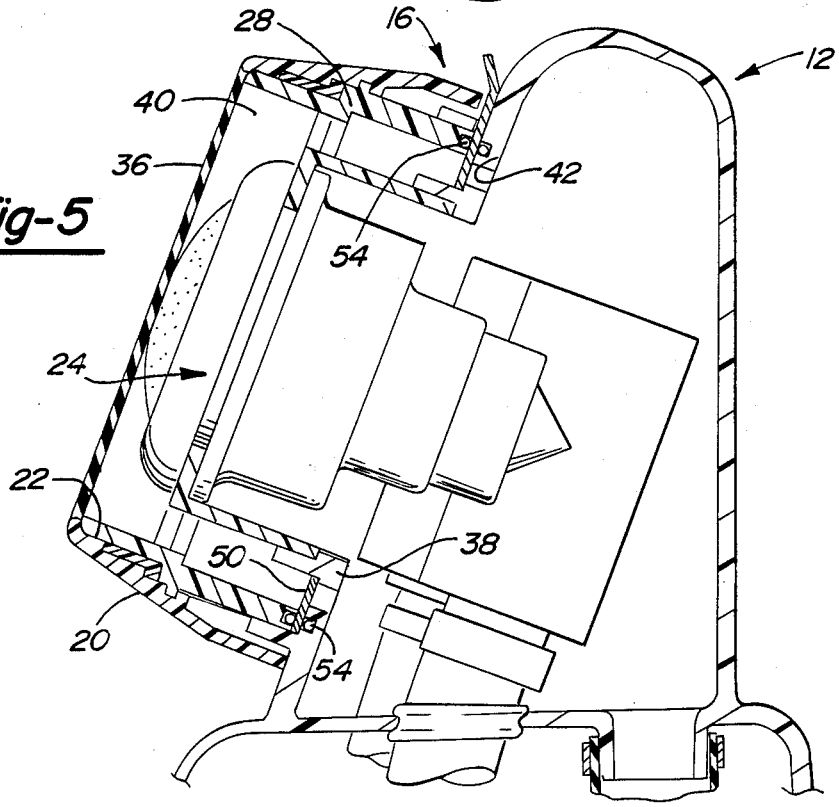
FIG. 5 is a cross-sectional view of a second embodiment of the dry hydro-massage unit of the present invention.

In an alternative embodiment shown in FIG. 5, the interior wall 38 is provided with a selectively adjustable shutter member 50 to variably control the flow of fluid through the ports 42. The shutter 50 is in the form of a rotatable dial with openings 52 to vary the size of the ports 42 by misaligning the openings 52 of the shutter 50 and the ports 42 of the wall 38. To prevent fluid leakage past the shutter 50, the housing 60 is provided with sealing O-rings 54. By varying the position of the shutter 50 relative to the ports 42 the outlet flow from the chamber 50 can be varied to vary the firmness of the inflated diaphragm 36. Means may be provided to prevent the shutter 50 from closing the ports 42 too much which may damage the jet assembly 24 or the diaphragm 36.

Thus, the present invention will provide a soothing dry hydro-massage of a user by eliminating the spray of the massaging jet. As a result, the hydro-massage unit can be mounted above the water line to provide soothing relief of the neck and shoulders, body parts normally positioned above the water line of a spa.

The foregoing detailed description has been given for clearness of understanding only and no unnecessary limitations should be understood therefrom as some modifications will be obvious to those skilled in the art without departing from the scope and spirit of the appended claims.

I claim:

1. A dry hydro-massaging unit for mounting to a spa tub, the dry hydro-massage unit providing selective massage of a user positioned within the tub, said dry hydro-massaging unit comprising:

a rigid housing mounted to the tub, said housing including a front opening;

a diaphragm sealingly covering said front opening of said housing to form a pressure chamber within said housing;

a hydro-massage jet assembly having a discharge jet mounted within said housing, said discharge jet positioned to discharge a massaging fluid into said pressure chamber of said housing and against said diaphragm whereby said massaging fluid from said discharge jet massagingly flexes said diaphragm;

means connected to said hydro-massage jet assembly for supplying said massaging fluid to said discharge jet; and means for restricting the exhaust of fluid from said pressure chamber of said housing such that the rate of massaging fluid flowing into said pressure chamber from said jet assembly is greater than the fluid flow rate from said pressure chamber thereby maintaining said diaphragm in a substantially constant state of inflation beyond said front opening so as to provide a pillow-like surface for the user to rest against.

2. The unit as defined in claim 1 wherein said means for restricting the exhaust of fluid from said pressure chamber includes an interior wall within said housing, said interior wall having at least one regulating port through which fluid from said pressure chamber flows into the remainder of said housing.

3. The unit as defined in claim 2 wherein said interior wall is an annular wall circumferentially mounted about said hydro-massage jet assembly within said housing, said annular wall including a plurality of circumferentially spaced ports, the number and diameter of said ports determining the fluid pressure within said chamber.

4. The unit as defined in claim 3 and further comprising means for selectively adjusting the diameter of said ports to selectively regulate fluid flow through said ports and the fluid pressure within pressure chamber.

5. The unit as defined in claim 2 wherein fluid from said housing is exhausted into the tub through fluid venting means.

6. The unit as defined in claim 1 wherein said housing includes air venting means.

7. The unit as defined in claim 1 wherein said discharge jet is a pulsating discharge jet providing a pulsating massaging fluid against said diaphragm.

8. The unit as defined in claim 1 wherein said discharge jet is a rotating discharge jet providing massaging fluid against said diaphragm in a circular motion.

9. The unit as defined in claim 1 wherein said discharge jet is a reciprocating discharge jet providing massaging fluid against said diaphragm in a reciprocating motion.

10. A dry hydro-massage unit for mounting to a spa tub, the hydro-massage unit providing selective massage of a user positioned within the tub, said dry hydro-massaging unit comprising:

a rigid housing mounted proximate the tub for selective engagement by the user positioned in the tub, said housing including a front opening;

a flexible diaphragm sealingly covering said front opening of said housing, said diaphragm enclosing a pressure chamber within said housing;

a hydro-massage jet assembly having a discharge jet mounted within said housing, said discharge jet positioned to discharge a massaging fluid into said pressure chamber of said housing and against said diaphragm whereby said massaging fluid from said discharge jet massagingly flexes said diaphragm while fluid flow past said diaphragm is prevented;

means fluidly connected to said hydro-massage jet assembly for supplying a massaging fluid to said jet for discharge against said diaphragm; and an interior wall within said housing proximate said hydro-massage jet assembly forming said pressure chamber within said housing, said interior wall including restrictive port means for regulating the exhaust of said massaging fluid from said pressure chamber behind said diaphragm thereby maintaining a predetermined fluid pressure within said chamber to maintain said diaphragm in a substantially constant state of inflation and beyond said front opening so as to provide a pillow-like surface for the user to rest against against which said massaging fluid from said discharge jet is discharged.

11. The unit as defined in claim 10 wherein said interior wall is an annular wall circumferentially mounted about said hydro-massage jet assembly within said housing, said annular wall including a plurality of circumferentially spaced ports forming said restrictive port means, the number and diameter of said ports determining the fluid pressure within said chamber to inflate said diaphragm.

12. The unit as defined in claim 11 and further comprising means for selectively restricting the exhaust of said massaging fluid from said pressure chamber through said ports.

13. The unit as defined in claim 12 wherein said means for selectively restricting includes a rotatable shutter member sealingly mounted adjacent said interior wall, said shutter member selectively adjusting the diameter of said ports upon rotation thereof relative to said interior wall.

14. The unit as defined in claim 10 wherein said housing includes air venting means for exhausting trapped air from said housing.

15. The unit as defined in claim 10 wherein said housing includes water venting means for returning discharged water from said housing to the tub.

16. A dry hydro-massage unit for mounting to a spa tub, the hydro-massage unit providing selective massage of a user positioned within the tub, said dry hydro-massaging unit comprising:

a rigid housing mounted proximate the tub for selective engagement by the user, said housing including a front opening and an interior wall forming a pressure chamber within said housing;

a flexible diaphragm sealingly covering said front opening of said housing, said diaphragm sealingly enclosing said pressure chamber of said housing to prevent fluid flow past said diaphragm;

a hydro-massage jet assembly having a discharge jet mounted within said housing, said discharge jet positioned to discharge a massaging fluid into said pressure chamber of said housing and against said diaphragm whereby said massaging fluid from said discharge jet massagingly flexes said diaphragm while fluid flow past said diaphragm is prevented; and means fluidly connected to said hydro-massage jet assembly for supplying a massaging fluid to said jet for discharge against said diaphragm;

said interior wall including a plurality of spaced apart ports of restricting the exhaust of fluid from said pressure chamber such that the rate of massaging fluid flowing into said pressure chamber from said jet assembly is greater than the fluid flow rate from said pressure chamber thereby maintaining a predetermined fluid pressure within said chamber to maintain said diaphragm in a substantially constant state of inflation beyond said front opening so as to provide a pillow-like surface for the user to rest against, the number and diameter of said ports controlling the fluid pressure within said chamber and the inflation of said diaphragm.

17. The unit as defined in claim 16 and further comprising means for selectively adjusting the restrictive exhaust of said massaging fluid from said pressure chamber through said ports to vary the inflation of said diaphragm.

* * * * *